US006876753B2

(12) United States Patent
Kim

(10) Patent No.: US 6,876,753 B2
(45) Date of Patent: Apr. 5, 2005

(54) COUPLING STRUCTURE OF SIGNAL CONVERTING APPARATUS

(75) Inventor: Nak Hyun Kim, Seoul (KR)

(73) Assignee: Sambu Communics Co., Ltd., Seoul (KR)

( * ) Notice: Subject to any disclaimer, the term of this patent is extended or adjusted under 35 U.S.C. 154(b) by 973 days.

(21) Appl. No.: 09/779,633

(22) Filed: Feb. 9, 2001

(65) Prior Publication Data

US 2002/0039406 A1 Apr. 4, 2002

(30) Foreign Application Priority Data

Oct. 4, 2000 (KR) ..... 2000-58238
Nov. 13, 2000 (KR) ..... 2000-67227
Jan. 31, 2001 (KR) ..... 2001-4592

(51) Int. Cl.[7] ..... H04R 25/00

(52) U.S. Cl. ..... 381/386; 381/361; 381/395; 181/171

(58) Field of Search ..... 381/355, 361, 381/366, 369, 386, 395, 396; 181/171, 199

(56) References Cited

U.S. PATENT DOCUMENTS 4,852,178 A * 7/1989 Inkman et al. ..... 381/395
5,619,585 A * 4/1997 Grasso ..... 381/396
5,699,438 A * 12/1997 Smith et al. ..... 381/386
6,061,460 A * 5/2000 Seo ..... 381/386

* cited by examiner

*Primary Examiner*—Suhan Ni
(74) *Attorney, Agent, or Firm*—Bacon & Thomas PLLC

(57) ABSTRACT

A coupling structure of a signal converting apparatus comprises: a frame having at least two coupling protrusions horizontally formed at an outer circumference thereof; a coupling member for coupling the signal converting apparatus; and a cylindrical coupling body being formed at an upper face of the coupling member and having horizontal and vertical cuts in a certain shape to correspond to the coupling protrusions wherein the coupling protrusions are inserted into a cylindrical coupling body of the coupling member, is rotated by a selected angle and is latched on the vertical and horizontal coupling grooves of the cylindrical coupling body such that the coupling member is integrally coupled to the signal converting apparatus.

10 Claims, 9 Drawing Sheets

COUPLING STRUCTURE OF SIGNAL CONVERTING APPARATUS

BACKGROUND OF THE INVENTION

1. Field of the Invention

The present invention relates to a signal converting apparatus established at an electronic device such as a cellular phone or a personal communication service(PCS) phone, for performing functions of a speaker or a vibrator, etc., and more particularly, to a coupling assembly of a signal converting apparatus having an improved coupling structure for the assembling between the signal converting apparatus and a coupling member of an electronic device such as a cellular phone or a PCS phone, thereby shortening the assemblying time of the signal converting apparatus and effectively using an establishing space.

2. Description of the Related Art

Generally, a cellular phone, a PCS phone, or a pager is provided with a speaker, a buzzer, or a vibrator, and so on, to inform the arrival of incoming signals transmitted from a sender via a base station. There is currently a trend in most of electronic devices including these communication apparatus to decrease the volumes of these devices and parts installed inside these devices.

Keeping pace with such a trend, as an alternative for minimizing various communication apparatus in their sizes, there appears a signal converting apparatus with various functions such as the vibrator function, the receiver function, and the speaker function. FIG. 1 shows one example of such a signal converting apparatus.

Referring to FIG. 1, a conventional signal converting apparatus includes a cylindrical frame 101 to which a grill and a vibrating plate are coupled at an upper portion and a lower portion thereof. A yoke is installed in the frame 101 by one or more springs. A magnet and a plate are stacked in the named order on the upper side and/or the lower side of the yoke. On the inner surfaces of the vibrating plate and the grill, a coil wound in a cylindrical shape and corresponding to the magnet is attached. The coil is connected to a terminal 102 integrally molded with the frame.

The above constituted signal converting apparatus are installed within a coupling member of electronic products such as a cellular phone or a PCS phone, and so on, for their use. The conventional signal converting apparatus, however, is not provided with an additional coupling unit to couple it to the coupling member of the electronic products. To this end, the terminal 102 is fixedly coupled to the coupling member or the integrated circuit board of the electronic products.

Such a coupling structure of the signal converting apparatus is very unstable and also needs an additional fixing means for the firm coupling of the signal converting apparatus. As a result, the assemblying time of the signal converting apparatus becomes long and a space occupied by the signal converting apparatus in the coupling member becomes wide, too. Thus, the above described drawbacks act as a difficulty in miniaturizing electronic products in their sizes.

SUMMARY OF THE INVENTION

Accordingly, it is an object of the present invention to shorten an assemblying time spent in fixing a signal converting apparatus to a coupling member of various electronic products.

It is another object of the present invention to minimize a space occupied by a signal converting apparatus on a coupling member of electronic products.

To accomplish these and other advantages, there is a coupling structure of a signal converting apparatus which comprises: a frame having at least two coupling protrusions horizontally formed at an outer circumference thereof; a coupling member for coupling the signal converting apparatus; and a cylindrical coupling body being formed at an upper face of the coupling member and having horizontal and vertical cuts in a certain shape to correspond to the coupling protrusions, wherein the coupling protrusions are inserted into the cylindrical coupling body of the coupling member and is rotated by a selected angle and is latched on the horizontal and vertical coupling grooves of the cylindrical coupling body such that the coupling member is integrally coupled to the signal converting apparatus.

Preferably, the coupling protrusion is formed during the molding of the frame by molding a part of the frame to be protruded wider than an outer circumference of the frame.

Preferably, the coupling protrusion is formed by molding the frame integrally with an extended end of a spring in the signal converting apparatus during the molding such that the extended end of a spring is extended from the outer surface of the spring to be longer than the outer diameter of the frame and is exposed out of the outer circumference of the frame.

Preferably, the width of the vertical coupling groove of the cylindrical coupling body is greater than the width of the coupling protrusion.

Preferably, the coupling structure further comprises a double-sided tape attached on an upper side of a coupling member and/or a lower side of the signal converting apparatus, for fixing the coupling member to the signal converting apparatus.

Preferably, the frame comprises a grill coupled to a lower side thereof and made by an injection molding wherein the frame is coupled to the grill by an ultrasonic wave welding.

According to another aspect of the present invention, there is provided a coupling structure of a signal converting apparatus comprising: a frame having at least two coupling protrusions horizontally formed at an outer circumference of the frame such that the coupling protrusions are directed toward an upper portion or a lower portion of the signal converting apparatus, the coupling protrusion having a latching jaw formed at one end of the coupling protrusion; and a coupling member having a coupling hole perforated to correspond to the coupling protrusion for coupling the signal converting apparatus, wherein the coupling protrusion is inserted into the coupling hole and is rotated by a selected angle to latch the latching jaw on the coupling member such that the coupling member is integrally coupled to the signal converting apparatus.

Preferably, the latching jaw is horizontally formed to be directed toward a rotational direction of the signal converting apparatus.

Preferably, the latching jaw is horizontally formed to be directed toward the center of the signal converting apparatus.

Preferably, the latching jaw comprises a fixing jaw formed at a lower face of the latching jaw and the coupling member comprises a fixing hole, wherein the fixing jaw is coupled to the fixing hole to prevent the signal converting apparatus fixed to the coupling member from swaying.

BRIEF DESCRIPTION OF THE DRAWINGS

The foregoing and other objects, features and advantages of the present invention will become more apparent from the following detailed description when taken in conjunction with the accompanying drawings in which.

DETAILED DESCRIPTION OF THE PREFERRED EMBODIMENTS

Hereinbelow, a coupling structure of a signal converting apparatus will be in detail described with reference to the accompanying drawings.

Figure 1:
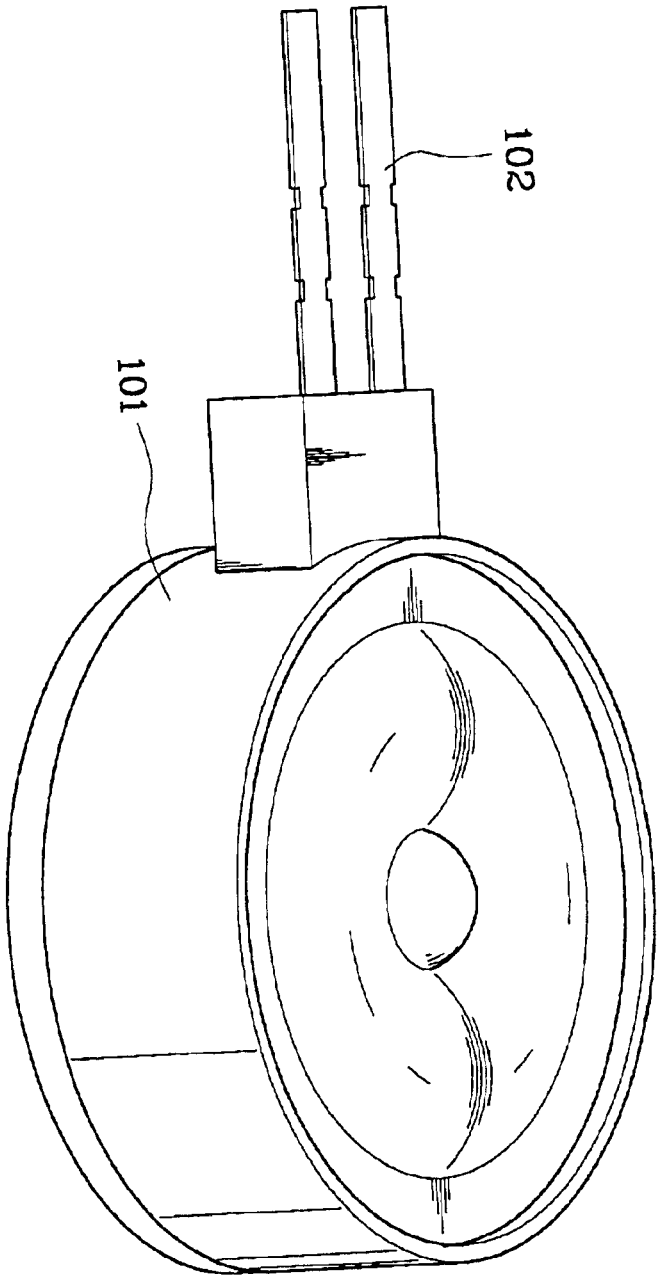
FIG. 1 is a perspective view of a conventional signal converting apparatus.
Figure 2:
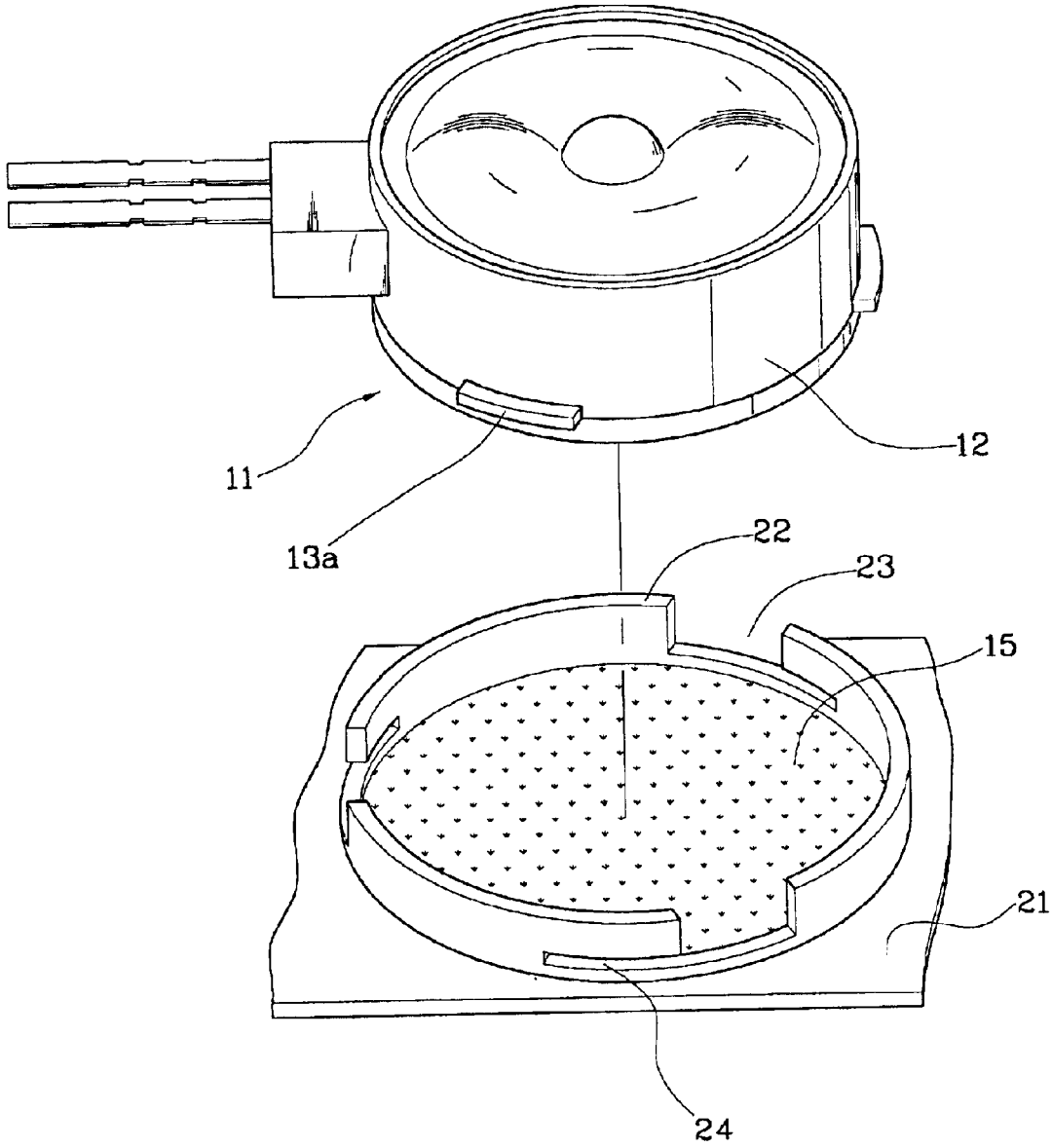
FIG. 2 is an exploded perspective view of a coupling structure of a signal converting apparatus in accordance with the present invention.
Figure 3:
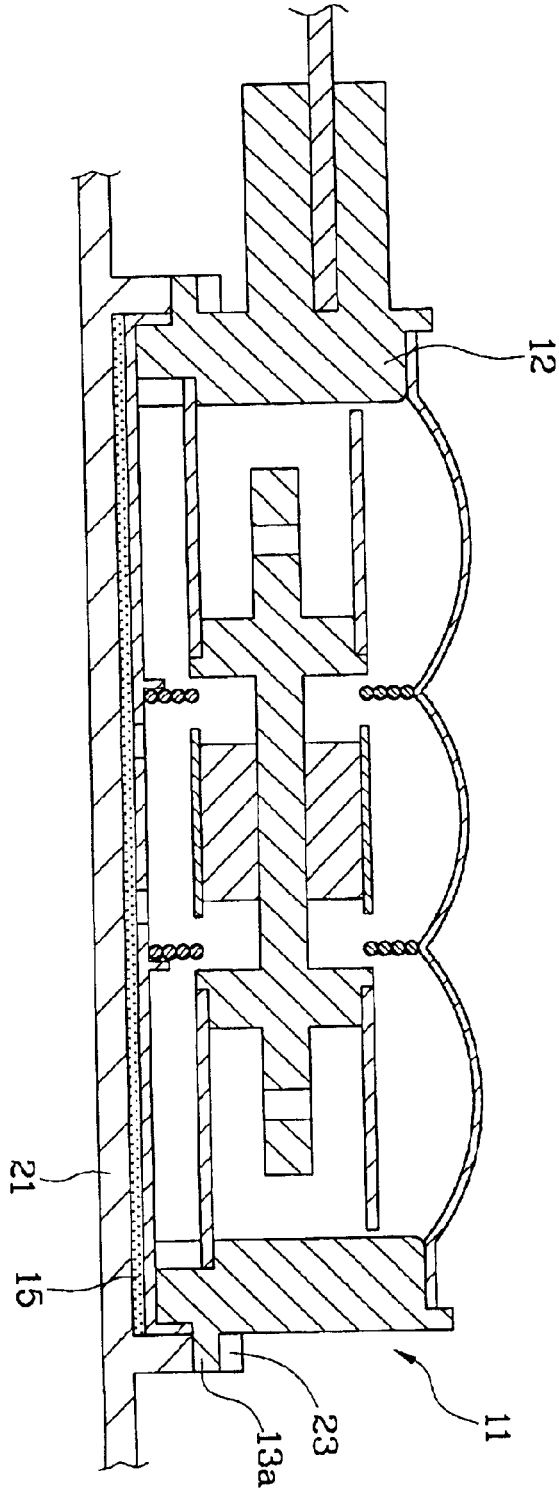
FIG. 3 is a sectional view of the signal converting apparatus in accordance with the present invention.

As shown in FIG. 2, a signal converting apparatus 11 such as a buzzer includes a frame 12, and is also provided with a yoke, a spring, a magnet, a plate, a coil, etc., within the frame 12. Two or more coupling protrusions 13*a* are horizontally formed at an outer circumference of the frame 12. The coupling protrusion 13*a* is formed upon molding the frame such that a part of the frame is protruded wider than an outer circumference of the frame.

Figure 5:
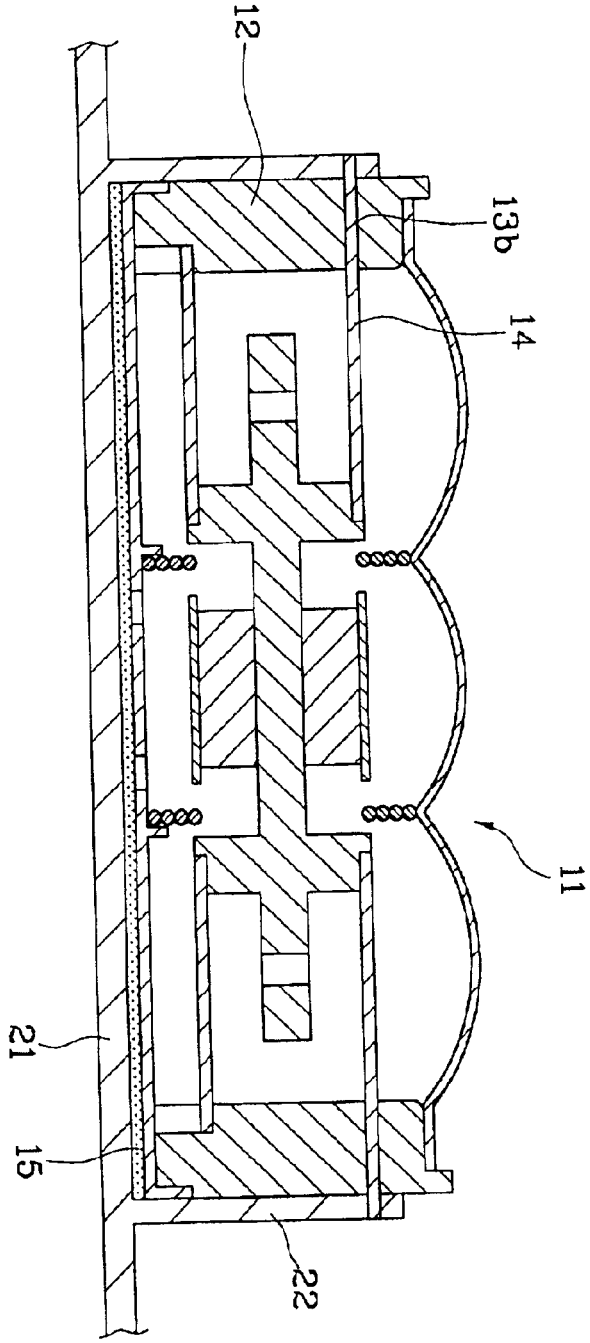
FIG. 5 is a sectional view of A—A line shown in FIG. 4 of the coupling structure of the signal converting apparatus in accordance with another embodiment of the present invention.

Alternatively, as shown in FIG. 5, the coupling protrusion 13*a* may be formed together with the frame 12 upon molding the frame 12. In other words, the coupling protrusion is formed by molding an extended end of a spring, which is extended from an outer surface of the spring 14 to be longer than the outer diameter of the frame 12, with the frame 12 in an integral form upon molding the frame 12. During the molding of the coupling protrusion, the extended end of the spring 14 is exposed to the outer circumference of the frame 12. At this time, depending on width and heights of the coupling protrusions 13*a* and 13*b*, the width of a vertical coupling groove 23 and the height of a horizontal coupling groove 24 to be described below should be naturally given.

Also, at an upper face of the coupling member 21 for coupling the signal converting apparatus 11, there are disposed the cylindrical coupling body 22 having coupling grooves 23, 24 having vertical and horizontal cuts to correspond to the coupling protrusion 13*a* formed at the frame 12.

The cylindrical coupling body 22 forms a circle such that they are coupled to the coupling protrusions 13*a* formed at the outer circumference by rotating the coupling body 22.

Here, the width of the horizontal coupling groove 23 cut vertically on a cylindrical coupling body 22 placed at the upper portion of the coupling member 21 is formed greater than the width of the coupling protrusion 13*a* formed on the outer circumference of a frame 12. Thereby, the coupling protrusion 13*a* of the frame 12 is inserted through the vertical coupling groove 23 of the cylindrical coupling body 22 into the cylindrical coupling body and is then rotated such that the signal converting apparatus 11 is integrally coupled to the coupling member 21.

Figure 4:
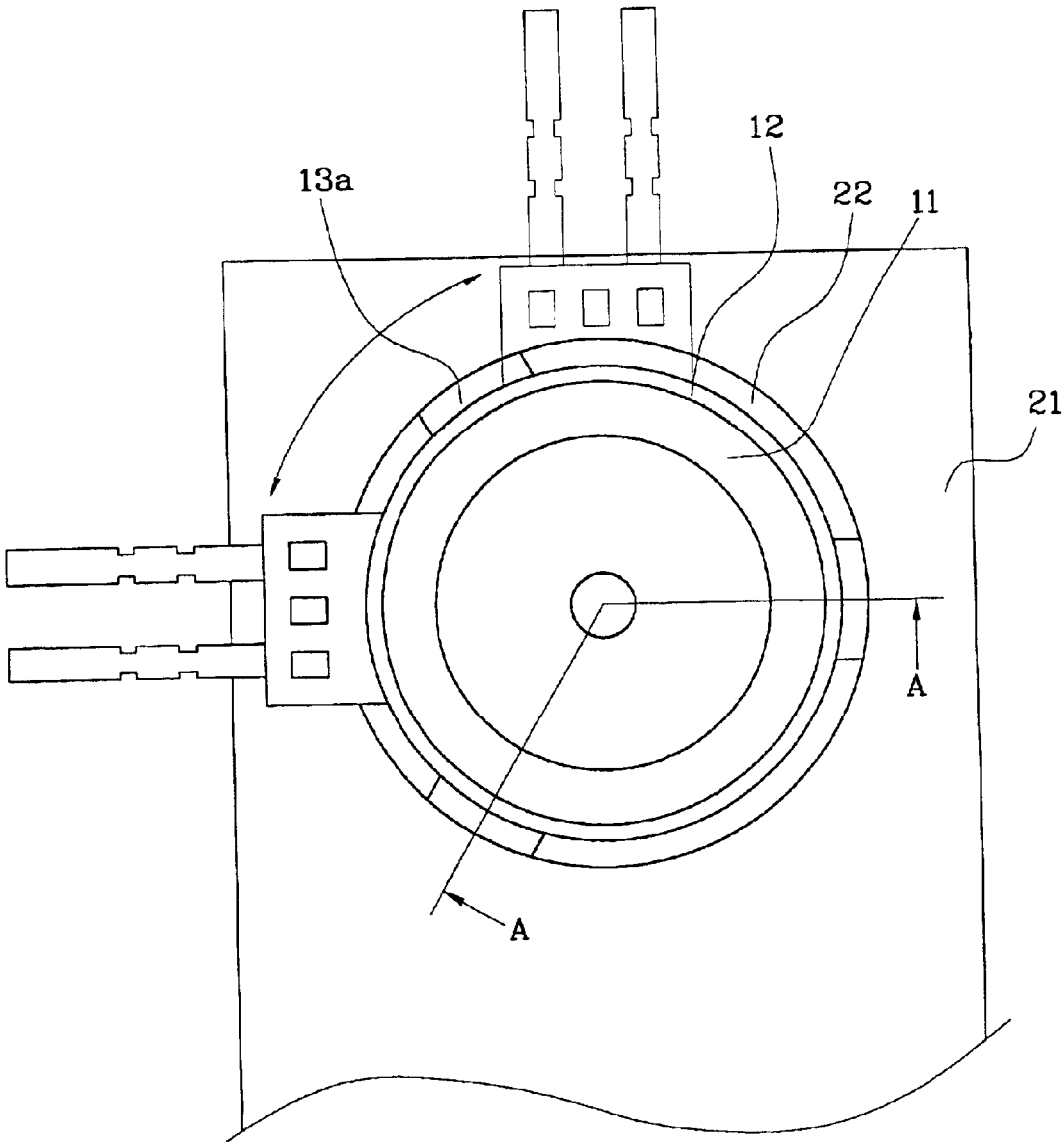
FIG. 4 is a plan view showing that the coupling member is coupled to the signal converting apparatus of the present invention.

In more detail, as shown in FIG. 4, the coupling protrusion 13*a* of the frame 12 is inserted into the cylindrical coupling body 22 of the coupling member 21 along the vertical coupling groove 23 and thereafter is rotated by a certain angle until the coupling protrusion 13*a* is hung on the horizontal coupling groove 24 of the cylindrical coupling body 22, thereby they are integrally coupled to each other. Thus, the aforementioned coupling structure decreases not only an assemblying time of the signal converting apparatus but also a space occupied by the signal converting apparatus on the coupling member.

Preferably, a double-sided tape is attached on a lower side of the signal converting apparatus 11 and/or an upper side of the coupling member 21, thereby firmly fixing the signal converting apparatus 11 coupled to the coupling member 21.

Although not shown in the drawings, an elastic member such as a spring is alternatively disposed between the signal converting apparatus 11 and the coupling member 21 instead of using the aforementioned double-sided tape for the firm fixing of the signal converting apparatus 11, thereby preventing the signal converting apparatus 11 from being deviated from an coupled status due to an impact or a vibration.

A grill is coupled to a lower side of the frame 12 to protect components installed inside the frame 12. The grill is made of a material easily applicable in the injection molding. The grill is coupled to the lower side of the frame 12 and thereafter it is welded using an ultrasonic wave, thereby decreasing the production costs of the signal converting apparatus and preventing the grill from being distorted by an external force during the assembly process of the signal converting apparatus as well.

Figure 6:
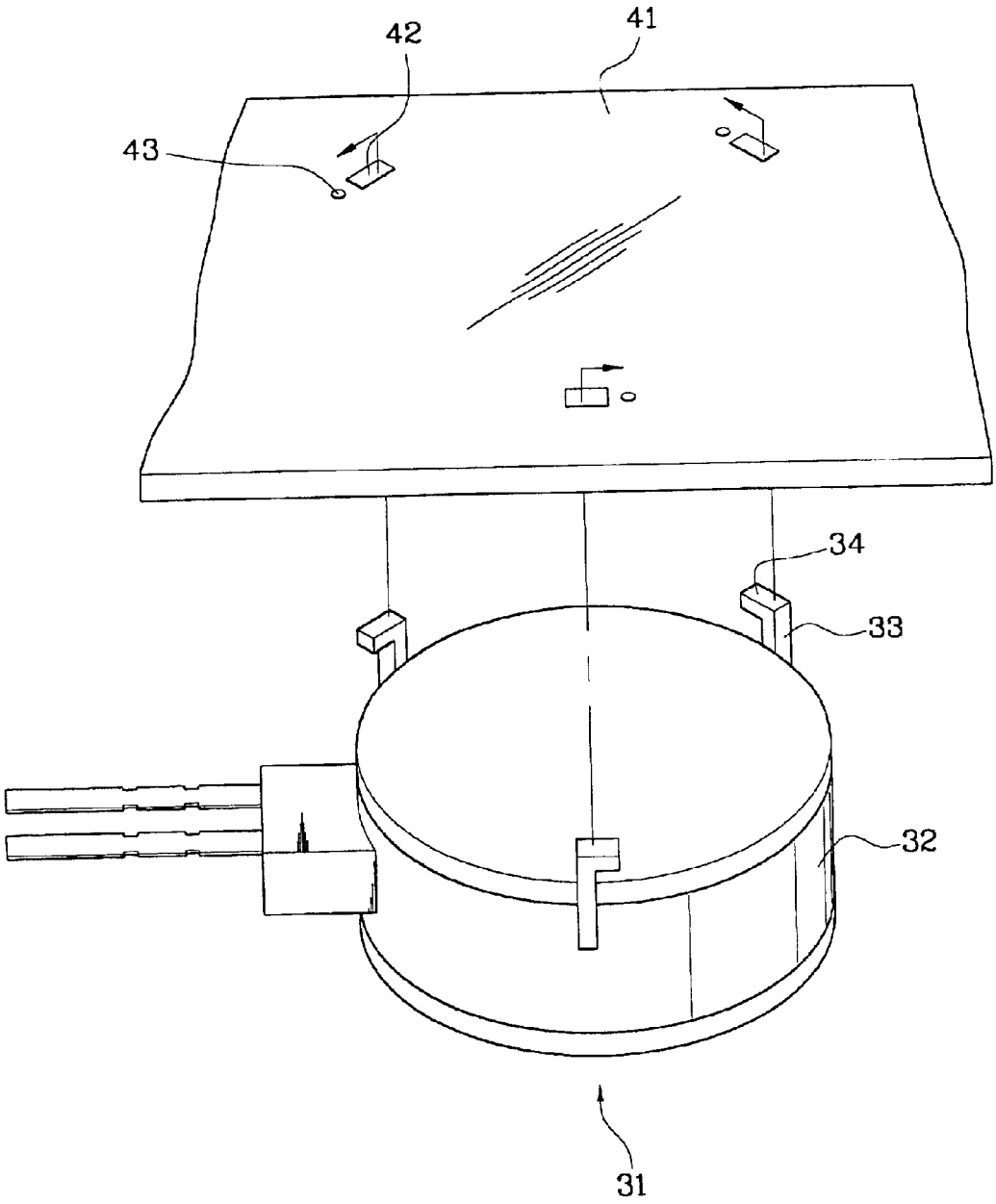
FIG. 6 is a bottom perspective view showing the coupling structure of the signal converting apparatus in accordance with another embodiment.
Figure 7:
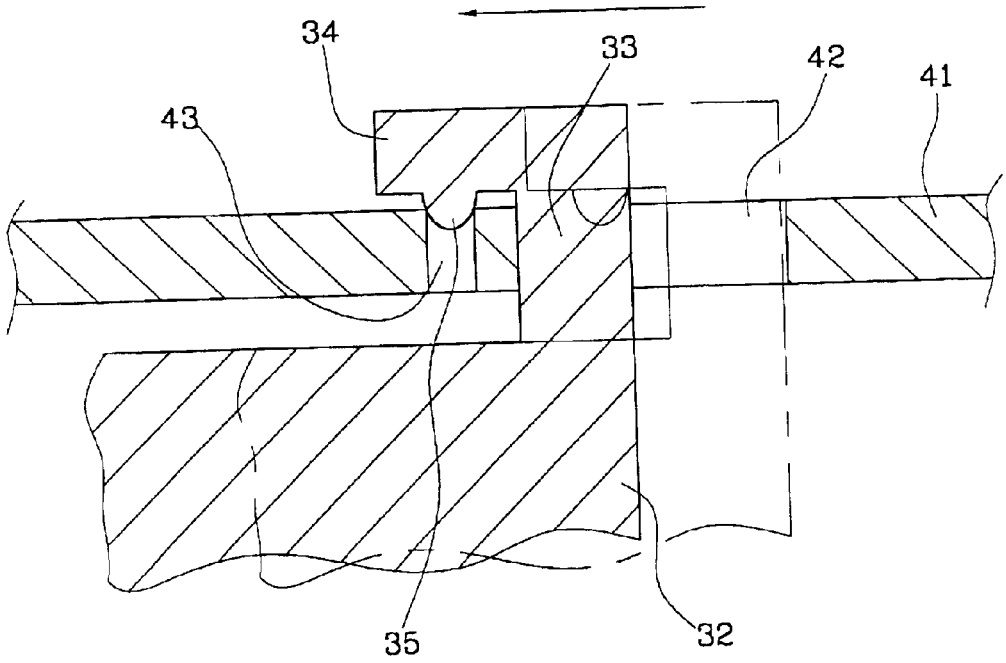
FIG. 7 is a sectional view showing a coupling relation between a latching jaw of the coupling protrusion and the fixing hole of the coupling member shown in FIG. 6.
Figure 8:
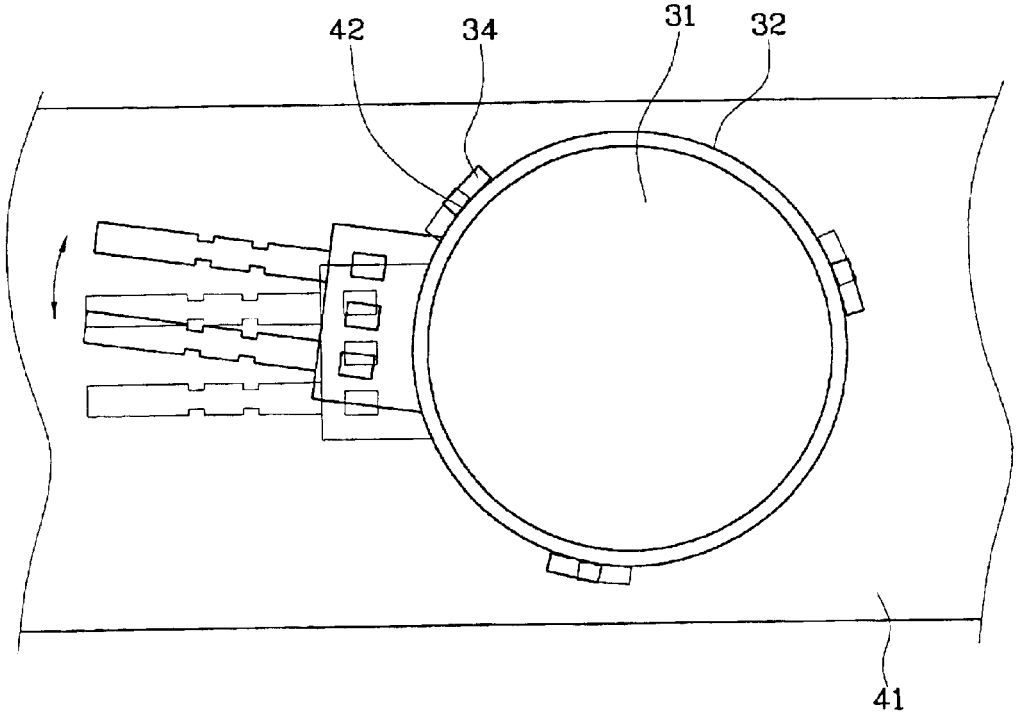
FIG. 8 is a plan view showing that the signal converting apparatus is coupled to the coupling member in accordance with another embodiment of the present invention.

FIG. 6 to FIG. 8 show another embodiments of the signal converting apparatus. Referring to FIG. 6 to FIG. 8, a coupling structure of a signal converting apparatus 31 includes a frame 32 and a coupling member 41. The frame 32 has at least two coupling protrusions 33 vertically formed at an outer circumference of the frame 32 provided with components such as a coil or a magnet therein such that the coupling protrusions 33 are directed toward an upper portion or a lower portion of the signal converting apparatus. The plural coupling protrusions 33 have a latching jaw 34 at one end of the coupling protrusions and the latching jaw 34 is bent horizontally and inwardly.

A distance between a cover coupled to the upper portion of the frame 32 and the latching jaw 34 of the coupling protrusion 33 is formed to be the same width as or to be greater than the thickness of the coupling member 41, thereby preventing the signal converting apparatus coupled to the coupling member 41 from being easily separated. The coupling member 41 has plural coupling holes 42 perforated. The coupling holes 42 have a proper size such that the coupling protrusions 33 are with ease coupled to the coupling holes 42.

Also, the latching jaw 34 includes a fixing jaw 35 formed at a lower face of the latching jaw 34 and the coupling member 41 includes a fixing hole 43 as well as the coupling hole 42. After completing the coupling process of the coupling member 41 and the signal converting apparatus, the fixing jaw 35 is inserted to the fixing hole 43 as shown in FIG. 7 and FIG. 8, to thereby prevent the signal converting apparatus fixed to the coupling member 41 from being separated.

It is desirable that the coupling protrusion 33 is made of a material such as plastic having a predetermined elasticity. The use of the plastic material allows the latching jaw 34 which had ascended during the assembly and has descended after the completion of the assembly to keep horizontal with the coupling member 33. As a result, the coupling protrusions 33 are not separated from the coupling holes 43 with ease.

Like the first embodiment, the aforementioned another embodiment decreases not only the assemblying time but also a space occupied by the signal converting apparatus on the coupling member.

Figure 9:
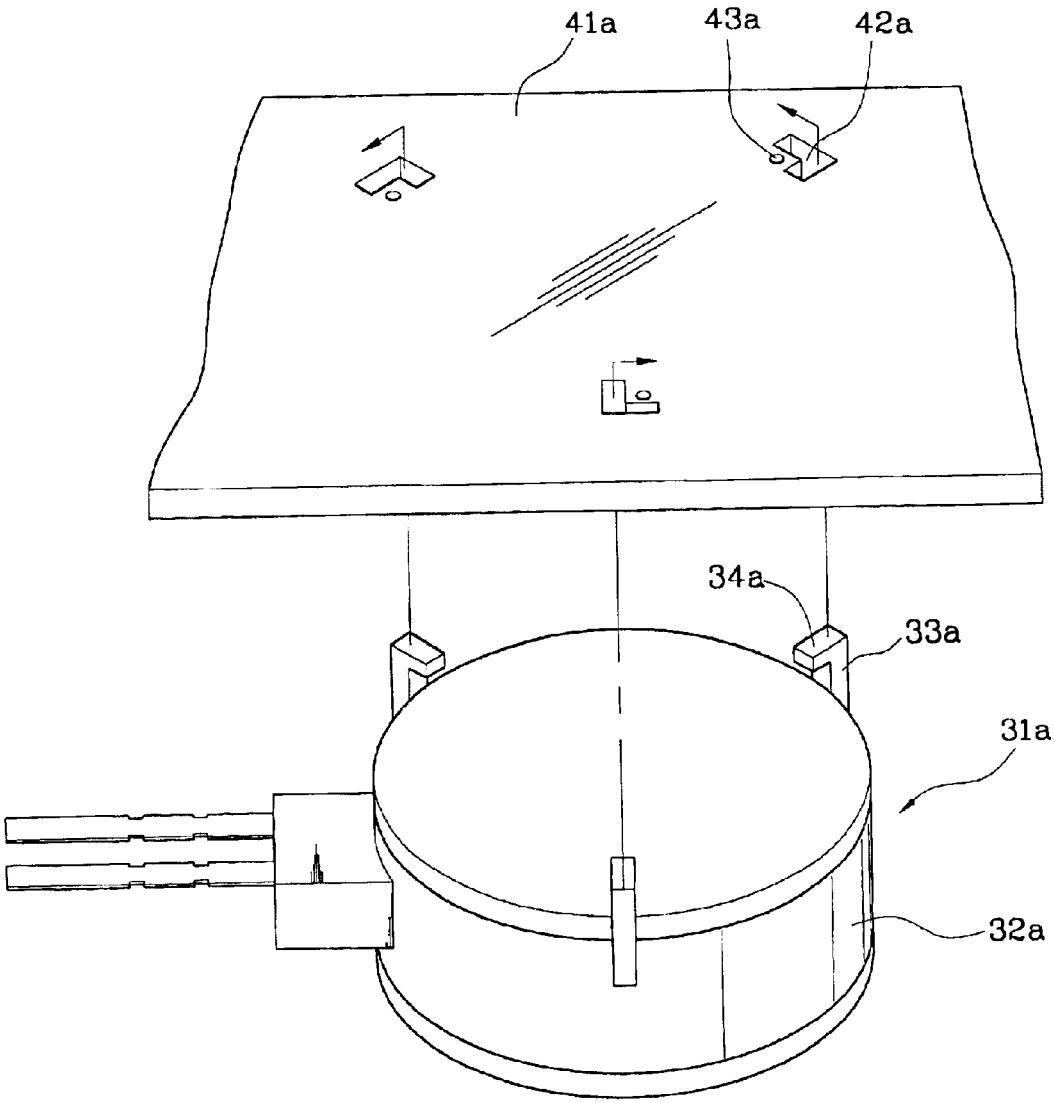
FIG. 9 is a bottom view showing the coupling structure of the signal converting apparatus in accordance with another embodiment of the present invention.

Referring to FIG. 9, the latching jaw 34*a* of the coupling protrusion 33*a* is bent to be directed toward the center of the signal converting apparatus 31*a*. The coupling hole 42*a* and the fixing hole 43 are formed to correspond to the position and the shape of the coupling protrusion 33*a* and the latching jaw 34*a* extended from the coupling protrusion 33*a*. The coupling structure shown in FIG. 9 shows the same effects with that of FIG. 6 to FIG. 8.

As described previously, the present invention not only shortens the assemblying time for fixing the signal converting apparatus to the coupling member such as a cellular phone, a pager, and so on but also minimizes a space occupied by the signal converting apparatus on the coupling member.

Especially, the invention further uses a double-sided tape to firmly couple the signal converting apparatus to the coupling member, thereby firmly fixing the signal converting apparatus 11 coupled to the coupling member 21. The grill is coupled to the lower side of the frame 12 and thereafter it is welded using an ultrasonic wave, thereby preventing the signal converting apparatus from being separated from the coupling member by an external force such as impacts or vibrations.

While this invention has been described in connection with what is presently considered to be the most practical and preferred embodiments, it is to be understood that the invention is not limited to the disclosed embodiments, but, on the contrary, it is intended to cover various modifications within the spirit and scope of the appended claims.

What is claimed is:

1. A coupling structure of a signal converting apparatus comprising:

a frame having at least two coupling protrusions horizontally formed at the outer circumference thereof;

a coupling member for coupling the signal converting apparatus; and a cylindrical coupling body being formed at an upper face of the coupling member and having horizontal and vertical coupling grooves in a certain shape to correspond to the coupling protrusions, wherein the coupling protrusions are inserted into the cylindrical coupling body of the coupling member and is rotated by a selected angle and is latched on the horizontal and vertical coupling grooves of the cylindrical coupling body such that the coupling member is integrally coupled to the signal converting apparatus.

2. The coupling structure of the signal converting apparatus of claim 1, wherein the coupling protrusion is formed during the molding of the frame by molding a part of the frame to be protruded wider than the outer circumference of the frame.

3. The coupling structure of the signal converting apparatus of claim 1, wherein the coupling protrusion is formed by molding the frame integrally with an extended end of a spring in the signal converting apparatus, wherein the extended end of a spring is extended from the outer surface of the spring to be longer than the outer diameter of the frame and is exposed out of the outer circumference of the frame.

4. The coupling structure of the signal converting apparatus of claim 1, wherein the width of the vertical coupling groove of the cylindrical coupling body is greater than the width of the coupling protrusion.

5. The coupling structure of the signal converting apparatus of claim 1, further comprising a double-sided tape attached on an upper side of coupling member and/or a lower side of the signal converting apparatus, for fixing the coupling member to the signal converting apparatus.

6. The coupling structure of the signal converting apparatus of claim 1, wherein the frame comprises a grill coupled to a lower side thereof and made by an injection molding wherein the frame is coupled to the grill by an ultrasonic wave welding.

7. A coupling structure of a signal converting apparatus comprising:

a frame having at least two coupling protrusions vertically formed at the outer circumference of the frame such that the coupling protrusions are directed toward an upper portion or a lower portion of the signal converting apparatus, the coupling protrusion having a latching jaw formed at one end of the coupling protrusion; and a coupling member having a coupling hole perforated to correspond to the coupling protrusion for coupling the signal converting apparatus, wherein the coupling protrusion is inserted into the coupling hole and is rotated by a selected angle to latch the latching jaw on the coupling member such that the coupling member is integrally coupled to the signal converting apparatus.

8. The coupling structure of the signal converting apparatus of claim 7, wherein the latching jaw is horizontally formed to be directed toward a rotational direction of the signal converting apparatus.

9. The coupling structure of the signal converting apparatus of claim 7, wherein the latching jaw is horizontally formed to be directed toward the center of the signal converting apparatus.

10. The coupling structure of the signal converting apparatus of claim 7, wherein the latching jaw comprises a fixing jaw formed at a lower face of the latching jaw and the coupling member comprises a fixing hole, wherein the fixing jaw is coupled to the fixing hole to prevent the signal converting apparatus fixed to the coupling member from swaying.

* * * * *